US009046008B2

(12) United States Patent
Meldolesi et al.

(10) Patent No.: US 9,046,008 B2
(45) Date of Patent: Jun. 2, 2015

(54) LOST-MOTION VARIABLE VALVE ACTUATION SYSTEM WITH VALVE DEACTIVATION

(71) Applicant: Scuderi Group, LLC, West Springfield, MA (US)

(72) Inventors: Riccardo Meldolesi, West Sussex (GB); John Schwoerer, Storrs, CT (US); Joseph Paturzo, Avon, CT (US); Bruce Swanbon, Tolland, CT (US)

(73) Assignee: Scuderi Group, LLC, West Springfield, MA (US)

( * ) Notice: Subject to any disclaimer, the term of this patent is extended or adjusted under 35 U.S.C. 154(b) by 0 days.

(21) Appl. No.: 14/205,505

(22) Filed: Mar. 12, 2014

(65) Prior Publication Data

US 2014/0182529 A1 Jul. 3, 2014

Related U.S. Application Data

(62) Division of application No. 13/359,537, filed on Jan. 27, 2012, now Pat. No. 8,707,916.

(60) Provisional application No. 61/436,741, filed on Jan. 27, 2011.

(51) Int. Cl.
*F01L 9/02* (2006.01)
*F01L 1/12* (2006.01)
(Continued)

(52) U.S. Cl.
CPC ... *F01L 1/12* (2013.01); *F01L 1/08* (2013.01); *F01L 1/181* (2013.01); *F01L 1/42* (2013.01);
(Continued)

(58) Field of Classification Search
CPC ..... F01L 1/255; F01L 1/245; F01L 1/24; F01L 1/2405; F01L 1/2411; F01L 1/2416; F01L 1/2422; F01L 1/26; F01L 1/183; F02B 33/20; F02B 33/22
USPC ..... 123/52.2, 52.5, 61 R, 62, 63, 66, 65 R, 123/70 R, 72, 65 VD, 90.42–90.43, 123/90.45–90.46, 90.48, 90.5, 90.52, 90.55, 123/90.12, 90.13, 90.15–90.16, 123/90.22–90.23, 90.35
See application file for complete search history.

(56) References Cited

U.S. PATENT DOCUMENTS 1,531,909 A 3/1925 Engemann
1,936,653 A 11/1933 Almen
(Continued)

FOREIGN PATENT DOCUMENTS

DE 101 15 967 A1 10/2002
DE 10 2007 019 916 A1 10/2008
(Continued)

OTHER PUBLICATIONS

Delphi CAM Phasers (website—NPL) 2010**.
(Continued)

*Primary Examiner* — Hung Q Nguyen
(74) *Attorney, Agent, or Firm* — Nutter McClennen & Fish LLP; John J. Penny, Jr.; Michael P. Visconti, III

(57) ABSTRACT

Devices and related methods are disclosed that generally involve the selective deactivation of one or more engine valves. In one embodiment, a split-cycle internal combustion engine is provided in which a high-speed trigger valve is used to fill and drain a hydraulic tappet that forms part of a lost-motion system of an engine valve. A spool valve can be used to selectively disconnect the tappet from the trigger valve, thereby deactivating the associated engine valve (i.e., preventing the engine valve from opening). The devices and methods disclosed herein also have application in conventional internal combustion engines and can be used with inwardly-opening and/or outwardly-opening valves.

2 Claims, 7 Drawing Sheets

(51) Int. Cl.

| | |
|---|---|
| ***F01L 1/08*** | (2006.01) |
| ***F01L 13/00*** | (2006.01) |
| ***F02B 33/22*** | (2006.01) |
| *F01L 1/18* | (2006.01) |
| *F01L 1/42* | (2006.01) |
| *F01L 3/00* | (2006.01) |

(52) U.S. Cl.

CPC ..... *F01L 13/0005* (2013.01); *F01L 13/0063* (2013.01); *F01L 2003/258* (2013.01); *F01L 2820/01* (2013.01); *F01L 2820/033* (2013.01); *F02B 33/22* (2013.01)

(56) References Cited

U.S. PATENT DOCUMENTS

| | | | | |
|---|---|---|---|---|
| 2,109,809 | A | | 3/1938 | Van Ranst |
| 2,218,575 | A | | 10/1940 | Griswold |
| 2,394,354 | A | | 2/1946 | Barr |
| 2,772,667 | A | | 12/1956 | Nallinger |
| 3,209,737 | A | | 10/1965 | Isao |
| 3,774,581 | A | | 11/1973 | Lundy |
| 3,786,792 | A | | 1/1974 | Pelizzoni et al. |
| 3,808,818 | A | | 5/1974 | Cataldo |
| 3,880,126 | A | | 4/1975 | Thurston et al. |
| 3,908,701 | A | | 9/1975 | Dawawala |
| 3,935,765 | A | | 2/1976 | Peltier et al. |
| 3,938,483 | A | | 2/1976 | Firey |
| 3,949,964 | A | | 4/1976 | Freeman |
| 4,111,165 | A | * | 9/1978 | Aoyama et al. ..... 123/90.15 |
| 4,133,172 | A | | 1/1979 | Cataldo |
| 4,224,798 | A | | 9/1980 | Brinkerhoff |
| 4,258,671 | A | * | 3/1981 | Takizawa et al. ..... 123/90.16 |
| 4,418,657 | A | | 12/1983 | Wishart |
| 4,606,314 | A | | 8/1986 | Yamazaki |
| 4,825,717 | A | | 5/1989 | Mills |
| 4,860,716 | A | | 8/1989 | Deutschmann |
| 4,934,652 | A | | 6/1990 | Golden |
| 5,018,487 | A | | 5/1991 | Shinkai |
| 5,080,054 | A | | 1/1992 | Nakamura |
| 5,101,776 | A | | 4/1992 | Ma |
| 5,113,813 | A | | 5/1992 | Rosa |
| 5,193,495 | A | | 3/1993 | Wood, III |
| 5,213,072 | A | | 5/1993 | Dohring |
| 5,402,756 | A | | 4/1995 | Bohme et al. |
| 5,445,119 | A | | 8/1995 | Regueiro |
| 5,555,861 | A | | 9/1996 | Mayr et al. |
| 5,664,531 | A | | 9/1997 | Kim |
| 5,690,066 | A | | 11/1997 | Hampton et al. |
| 5,713,316 | A | | 2/1998 | Sturman |
| 5,964,087 | A | | 10/1999 | Tort-Oropeza |
| 5,988,124 | A | | 11/1999 | Duesmann |
| 6,085,705 | A | | 7/2000 | Vorih |
| 6,152,714 | A | | 11/2000 | Mitsuya et al. |
| 6,192,841 | B1 | | 2/2001 | Vorih et al. |
| 6,230,472 | B1 | | 5/2001 | Stahlecker |
| 6,230,742 | B1 | | 5/2001 | Bircann |
| 6,257,183 | B1 | | 7/2001 | Vorih et al. |
| 6,267,098 | B1 | | 7/2001 | Vanderpoel |
| 6,273,057 | B1 | | 8/2001 | Schwoerer et al. |
| 6,302,370 | B1 | | 10/2001 | Schwoerer et al. |
| 6,332,917 | B1 | | 12/2001 | Schollkopf |
| 6,397,579 | B1 | | 6/2002 | Negre |
| 6,412,457 | B1 | | 7/2002 | Vorih et al. |
| 6,474,277 | B1 | | 11/2002 | Vanderpoel et al. |
| 6,510,824 | B2 | | 1/2003 | Vorih et al. |
| 6,543,225 | B2 | | 4/2003 | Scuderi |
| 6,584,885 | B2 | | 7/2003 | Lou |
| 6,609,371 | B2 | | 8/2003 | Scuderi |
| 6,619,873 | B2 | | 9/2003 | Parker |
| 6,647,954 | B2 | | 11/2003 | Yang et al. |
| 6,655,327 | B1 | | 12/2003 | Hedman |
| 6,694,933 | B1 | | 2/2004 | Lester |
| 6,745,738 | B1 | | 6/2004 | Bosscher |
| 6,789,514 | B2 | | 9/2004 | Suh et al. |
| 6,874,453 | B2 | | 4/2005 | Coney et al. |
| 6,883,775 | B2 | | 4/2005 | Coney et al. |
| 6,886,511 | B1 | | 5/2005 | Tong et al. |
| 6,952,923 | B2 | | 10/2005 | Branyon et al. |
| 7,077,083 | B2 | | 7/2006 | Dingle et al. |
| 7,140,332 | B2 | | 11/2006 | Klein et al. |
| 7,156,062 | B2 | | 1/2007 | Vanderpoel |
| 7,171,930 | B2 | | 2/2007 | Keel |
| 7,314,027 | B2 | | 1/2008 | Murata |
| 7,353,786 | B2 | | 4/2008 | Scuderi et al. |
| 7,430,997 | B2 | | 10/2008 | Muraji et al. |
| 7,481,190 | B2 | | 1/2009 | Scuderi |
| 7,513,224 | B2 | | 4/2009 | Heaton |
| 7,536,984 | B2 | | 5/2009 | Lou |
| 7,603,970 | B2 | | 10/2009 | Scuderi et al. |
| 7,628,126 | B2 | | 12/2009 | Scuderi |
| 7,637,234 | B2 | | 12/2009 | Tussing et al. |
| 7,690,337 | B2 | | 4/2010 | Pirault et al. |
| 7,810,459 | B2 | | 10/2010 | Branyon et al. |
| 7,823,547 | B2 | | 11/2010 | Forner, Sr. et al. |
| 7,963,259 | B2 | | 6/2011 | Meldolesi et al. |
| 8,707,916 | B2 | | 4/2014 | Meldolesi et al. |
| 8,776,740 | B2 | | 7/2014 | Meldolesi et al. |
| 2002/0152976 | A1 | | 10/2002 | Nguyen |
| 2002/0185091 | A1 | | 12/2002 | Vorih et al. |
| 2003/0192496 | A1 | | 10/2003 | Walters |
| 2003/0221663 | A1 | | 12/2003 | Vanderpoel et al. |
| 2004/0065308 | A1 | | 4/2004 | Bryant |
| 2005/0022768 | A1 | | 2/2005 | Tores et al. |
| 2005/0076868 | A1 | | 4/2005 | Mott et al. |
| 2005/0132987 | A1 | | 6/2005 | Chang |
| 2005/0268609 | A1 | | 12/2005 | Branyon et al. |
| 2006/0011154 | A1 | | 1/2006 | Scuderi et al. |
| 2006/0096560 | A1 | | 5/2006 | Afjeh et al. |
| 2006/0273271 | A1 | | 12/2006 | Yang et al. |
| 2007/0101958 | A1 | | 5/2007 | Seitz |
| 2007/0157894 | A1 | | 7/2007 | Scuderi et al. |
| 2007/0186883 | A1 | | 8/2007 | Hedman |
| 2007/0204818 | A1 | | 9/2007 | Dingle |
| 2007/0272180 | A1 | | 11/2007 | Lou |
| 2008/0054205 | A1 | | 3/2008 | Lou |
| 2008/0078345 | A1 | | 4/2008 | Knauf et al. |
| 2008/0105225 | A1 | | 5/2008 | Scuderi et al. |
| 2008/0196683 | A1 | | 8/2008 | Hayman et al. |
| 2008/0202159 | A1 | | 8/2008 | Fountain |
| 2008/0202454 | A1 | | 8/2008 | Pirault |
| 2008/0251041 | A1 | | 10/2008 | Lou |
| 2009/0038596 | A1 | | 2/2009 | Pirault et al. |
| 2009/0038598 | A1 | | 2/2009 | Phillips |
| 2009/0044778 | A1 | | 2/2009 | Scuderi et al. |
| 2009/0107433 | A1 | | 4/2009 | Tanaka |
| 2009/0133648 | A1 | | 5/2009 | Lou |
| 2009/0205598 | A1 | | 8/2009 | Takahashi et al. |
| 2009/0266347 | A1 | | 10/2009 | Scuderi et al. |
| 2009/0276992 | A1 | | 11/2009 | Maeda et al. |
| 2010/0095918 | A1 | | 4/2010 | Cecur |
| 2010/0116231 | A1 | | 5/2010 | Toda et al. |
| 2010/0126442 | A1 | | 5/2010 | Lou |
| 2010/0132644 | A1 | | 6/2010 | Methley et al. |
| 2010/0161202 | A1 | | 6/2010 | Ide et al. |
| 2010/0180847 | A1 | | 7/2010 | Meldolesi et al. |
| 2010/0180848 | A1 | | 7/2010 | Meldolesi et al. |
| 2010/0180875 | A1 | | 7/2010 | Meldolesi et al. |
| 2010/0186693 | A1 | | 7/2010 | Ezaki |
| 2010/0263646 | A1 | | 10/2010 | Giannini et al. |
| 2010/0274466 | A1 | | 10/2010 | Takamiya |
| 2010/0282225 | A1 | | 11/2010 | Gilbert et al. |
| 2010/0300385 | A1 | | 12/2010 | Durrett et al. |
| 2011/0036316 | A1 | | 2/2011 | de Ojeda et al. |
| 2011/0220081 | A1 | | 9/2011 | Meldolesi et al. |
| 2012/0192817 | A1 | | 8/2012 | Meldolesi et al. |
| 2012/0192818 | A1 | | 8/2012 | Meldolesi et al. |

(56) References Cited

U.S. PATENT DOCUMENTS

| | | | |
|---|---|---|---|
| 2012/0192840 | A1 | 8/2012 | Meldolesi et al. |
| 2012/0192841 | A1 | 8/2012 | Meldolesi et al. |
| 2014/0283772 | A1 | 9/2014 | Meldolesi et al. |

FOREIGN PATENT DOCUMENTS

| | | | |
|---|---|---|---|
| GB | 2 250 801 | A | 6/1992 |
| GB | 2 340 881 | A | 3/2000 |
| JP | 40-010860 | | 4/1965 |
| JP | 62-029407 | U | 2/1987 |
| JP | 01-115808 | U | 8/1989 |
| JP | 03-085309 | A | 4/1991 |
| JP | 04-179810 | A | 6/1992 |
| JP | 06-159024 | A | 6/1994 |
| JP | 06-272521 | A | 9/1994 |
| JP | 07-071278 | A | 3/1995 |
| JP | 10-274105 | A | 10/1998 |
| JP | 11-072013 | A | 3/1999 |
| JP | 2000-220420 | A | 8/2000 |
| JP | 2001-522014 | A | 11/2001 |
| JP | 2002-266610 | A | 9/2002 |
| JP | 2003-097232 | A | 4/2003 |
| JP | 2004-293695 | A | 10/2004 |
| JP | 2005-233031 | A | 9/2005 |
| JP | 2006-274939 | A | 10/2006 |
| JP | 2009-036076 | A | 2/2009 |
| JP | 2009-275713 | A | 11/2009 |
| JP | 2010-529367 | A | 8/2010 |
| WO | 2006/094213 | A1 | 9/2006 |
| WO | 2010/085488 | A1 | 7/2010 |
| WO | 2010/120499 | A1 | 10/2010 |

OTHER PUBLICATIONS

Hydraulic Valve Lash Adjustment Elements, INA p. 4-11. 1996.**.

Hydraulics Theory and Applications, Bosch, ISBN 3-9805925-3-7, 1998**.

International Search Report and Written Opinion for Application No. PCT/US2012/022834 dated May 11, 2012.** (9 pages).

International Search Report and Written Opinion for Application No. PCT/US2012/022839 dated May 11, 2012.** (9 pages).

International Search Report and Written Opinion for Application. PCT/US2012/022830 dated Aug. 31, 2012 (13 pages)**.

International Search Report and Written Opinion mailed May 21, 2012 for Application No. PCT/US2012/022836 (7 Pages)**.

Kolbenschmidt Pierburg Group, "Exhaust Gas Recirculation," Product Brochure, Pierburg GmbH Neuss, 2007**.

Piston Pump: http://www.boschrexroth.com/country_units/america/canada/en/10_products/technology_areas/compu-spread/technical_documents/a1Ovo_piston_pump/a1Ovo_pistonpump_manual.pdf (Downloaded Oct. 25, 2011)**.

Smith, Tuning and Maintenance of M.G.s, A.M.I.Mech.E., 1938**.

Technical Note, A Prototype Spool Valve for Use in Hyrdaulically Powered Arm Prosthesis, http://www.springerlink.com/content/a28v67u483676r8k/ (cover page only) Med Biol Eng. 1972;10:796-7. Last Accessed May 10, 2012.**.

The Illustrated Catalogue of Spares, Seventh Edition, Sports & Vintage Motors (Shrewsbury) Limited. 1990.**.

Urata, et al. (Honda), A Study of Vehicle Equipped with Non-Throttling S.I. Engine with Early Intake Valve Closing Mechanism, SAE paper 930820 (1993).**.

Extended European Search Report and Written Opinion for Application No. 12739579.6, mailed Sep. 29, 2014 (5 pages).

Japanese Office Action for Application No. 2013-551355, issued Jul. 29, 2014 (9 pages).

Japanese Office Action for Application No. 2013-551356, issued Aug. 5, 2014 (8 pages).

Japanese Office Action for Application No. 2013-551358, issued Aug. 5, 2014 (7 pages).

* cited by examiner

LOST-MOTION VARIABLE VALVE ACTUATION SYSTEM WITH VALVE DEACTIVATION

CROSS-REFERENCE TO RELATED APPLICATIONS

This application is a divisional of U.S. patent application Ser. No. 13/359,537, filed on Jan. 27, 2012, which claims the benefit of priority of U.S. Provisional Patent Application No. 61/436,741, filed on Jan. 27, 2011, the entire contents of each of which are incorporated herein by reference.

FIELD

The present invention relates to valve actuation systems. More particularly, the invention relates to a split-cycle internal combustion engine having a lost-motion variable valve actuation system in which one or more valves can be deactivated.

BACKGROUND

Internal combustion engines generally include one or more valves for controlling the flow of air and fuel through the engine. These valves are usually actuated by a mechanical cam. For example, a rotating shaft having a teardrop-shaped cam lobe is configured to impart motion to the valve, either directly or via one or more intermediate valve train elements. As the shaft rotates, the eccentric portion of the cam lobe imparts a linear motion to the valve over a range of the shaft's rotation.

"Lost-motion" systems can also be incorporated into the valve train. Lost-motion systems generally include a lost-motion valve train element that can be selectively actuated to operatively disconnect a cam from a valve during a portion of the cam's rotation. The motion that would have otherwise been imparted to the valve (had the valve not been operatively disconnected) is thus lost. Such systems allow, for example, a valve to be closed earlier than what is called for by the cam.

In some situations, it is desirable to deactivate an engine valve altogether (i.e., to hold the valve closed or to prevent the valve from opening). This is particularly desirable for partial load control of certain split-cycle or split-cycle air-hybrid engines. Accordingly, there is a need for improved valve actuation systems that allow for deactivation of one or more associated engine valves.

For purposes of clarity, the term "conventional engine" as used in the present application refers to an internal combustion engine wherein all four strokes of the well-known Otto cycle (the intake, compression, expansion and exhaust strokes) are contained in each piston/cylinder combination of the engine. Each stroke requires one half revolution of the crankshaft (180 degrees crank angle ("CA")), and two full revolutions of the crankshaft (720 degrees CA) are required to complete the entire Otto cycle in each cylinder of a conventional engine.

Also, for purposes of clarity, the following definition is offered for the term "split-cycle engine" as may be applied to engines disclosed in the prior art and as referred to in the present application.

A split-cycle engine generally comprises:

a crankshaft rotatable about a crankshaft axis;

a compression piston slidably received within a compression cylinder and operatively connected to the crankshaft such that the compression piston reciprocates through an intake stroke and a compression stroke during a single rotation of the crankshaft;

an expansion (power) piston slidably received within an expansion cylinder and operatively connected to the crankshaft such that the expansion piston reciprocates through an expansion stroke and an exhaust stroke during a single rotation of the crankshaft; and a crossover passage interconnecting the compression and expansion cylinders, the crossover passage including at least a crossover expansion (XovrE) valve disposed therein, but more preferably including a crossover compression (XovrC) valve and a crossover expansion (XovrE) valve defining a pressure chamber therebetween.

A split-cycle air hybrid engine combines a split-cycle engine with an air reservoir and various controls. This combination enables the engine to store energy in the form of compressed air in the air reservoir. The compressed air in the air reservoir is later used in the expansion cylinder to power the crankshaft. In general, a split-cycle air hybrid engine as referred to herein comprises:

a crankshaft rotatable about a crankshaft axis;

a compression piston slidably received within a compression cylinder and operatively connected to the crankshaft such that the compression piston reciprocates through an intake stroke and a compression stroke during a single rotation of the crankshaft;

an expansion (power) piston slidably received within an expansion cylinder and operatively connected to the crankshaft such that the expansion piston reciprocates through an expansion stroke and an exhaust stroke during a single rotation of the crankshaft;

a crossover passage (port) interconnecting the compression and expansion cylinders, the crossover passage including at least a crossover expansion (XovrE) valve, but more preferably including a crossover compression (XovrC) valve and a crossover expansion (XovrE) valve defining a pressure chamber therebetween; and an air reservoir operatively connected to the crossover passage and selectively operable to store compressed air from the compression cylinder and to deliver compressed air to the expansion cylinder.

FIG. 1 illustrates one exemplary embodiment of a prior art split-cycle air hybrid engine. The split-cycle engine 100 replaces two adjacent cylinders of a conventional engine with a combination of one compression cylinder 102 and one expansion cylinder 104. The compression cylinder 102 and the expansion cylinder 104 are formed in an engine block in which a crankshaft 106 is rotatably mounted. Upper ends of the cylinders 102, 104 are closed by a cylinder head 130. The crankshaft 106 includes axially displaced and angularly offset first and second crank throws 126, 128, having a phase angle therebetween. The first crank throw 126 is pivotally joined by a first connecting rod 138 to a compression piston 110 and the second crank throw 128 is pivotally joined by a second connecting rod 140 to an expansion piston 120 to reciprocate the pistons 110, 120 in their respective cylinders 102, 104 in a timed relation determined by the angular offset of the crank throws and the geometric relationships of the cylinders, crank, and pistons. Alternative mechanisms for relating the motion and timing of the pistons can be utilized if desired. The rotational direction of the crankshaft and the relative motions of the pistons near their bottom dead center (BDC) positions are indicated by the arrows associated in the drawings with their corresponding components.

The four strokes of the Otto cycle are thus "split" over the two cylinders 102 and 104 such that the compression cylinder 102 contains the intake and compression strokes and the expansion cylinder 104 contains the expansion and exhaust strokes. The Otto cycle is therefore completed in these two cylinders 102, 104 once per crankshaft 106 revolution (360 degrees CA).

During the intake stroke, intake air is drawn into the compression cylinder 102 through an inwardly-opening (opening inward into the cylinder and toward the piston) poppet intake valve 108. During the compression stroke, a compression piston 110 pressurizes the air charge and drives the air charge through a crossover passage 112, which acts as the intake passage for the expansion cylinder 104. The engine 100 can have one or more crossover passages 112.

The volumetric (or geometric) compression ratio of the compression cylinder 102 of the split-cycle engine 100 (and for split-cycle engines in general) is herein referred to as the "compression ratio" of the split-cycle engine. The volumetric (or geometric) compression ratio of the expansion cylinder 104 of the engine 100 (and for split-cycle engines in general) is herein referred to as the "expansion ratio" of the split-cycle engine. The volumetric compression ratio of a cylinder is well known in the art as the ratio of the enclosed (or trapped) volume in the cylinder (including all recesses) when a piston reciprocating therein is at its bottom dead center (BDC) position to the enclosed volume (i.e., clearance volume) in the cylinder when said piston is at its top dead center (TDC) position. Specifically for split-cycle engines as defined herein, the compression ratio of a compression cylinder is determined when the XovrC valve is closed. Also specifically for split-cycle engines as defined herein, the expansion ratio of an expansion cylinder is determined when the XovrE valve is closed.

Due to very high volumetric compression ratios (e.g., 20 to 1, 30 to 1, 40 to 1, or greater) within the compression cylinder 102, an outwardly-opening (opening outwardly away from the cylinder and piston) poppet crossover compression (XovrC) valve 114 at the crossover passage inlet is used to control flow from the compression cylinder 102 into the crossover passage 112. Due to very high volumetric compression ratios (e.g., 20 to 1, 30 to 1, 40 to 1, or greater) within the expansion cylinder 104, an outwardly-opening poppet crossover expansion (XovrE) valve 116 at the outlet of the crossover passage 112 controls flow from the crossover passage 112 into the expansion cylinder 104. The actuation rates and phasing of the XovrC and XovrE valves 114, 116 are timed to maintain pressure in the crossover passage 112 at a high minimum pressure (typically 20 bar or higher at full load) during all four strokes of the Otto cycle.

At least one fuel injector 118 injects fuel into the pressurized air at the exit end of the crossover passage 112 in coordination with the XovrE valve 116 opening. Alternatively, or in addition, fuel can be injected directly into the expansion cylinder 104. The fuel-air charge fully enters the expansion cylinder 104 shortly after the expansion piston 120 reaches its top dead center ("TDC") position. As the piston 120 begins its descent from its TDC position, and while the XovrE valve 116 is still open, one or more spark plugs 122 are fired to initiate combustion (typically between 10 to 20 degrees CA after TDC of the expansion piston 120). Combustion can be initiated while the expansion piston is between 1 and 30 degrees CA past its TDC position. More preferably, combustion can be initiated while the expansion piston is between 5 and 25 degrees CA past its TDC position. Most preferably, combustion can be initiated while the expansion piston is between 10 and 20 degrees CA past its TDC position. Additionally, combustion can be initiated through other ignition devices and/or methods, such as with glow plugs, microwave ignition devices, or through compression ignition methods.

The XovrE valve 116 is then closed before the resulting combustion event enters the crossover passage 112. The combustion event drives the expansion piston 120 downward in a power stroke. Exhaust gases are pumped out of the expansion cylinder 104 through an inwardly-opening poppet exhaust valve 124 during the exhaust stroke.

With the split-cycle engine concept, the geometric engine parameters (i.e., bore, stroke, connecting rod length, compression ratio, etc.) of the compression and expansion cylinders are generally independent from one another. For example, the crank throws 126, 128 for the compression cylinder 102 and expansion cylinder 104, respectively, have different radii and are phased apart from one another with TDC of the expansion piston 120 occurring prior to TDC of the compression piston 110. This independence enables the split-cycle engine to potentially achieve higher efficiency levels and greater torques than typical four-stroke engines.

The geometric independence of engine parameters in the split-cycle engine 100 is also one of the main reasons why pressure can be maintained in the crossover passage 112 as discussed earlier. Specifically, the expansion piston 120 reaches its top dead center position prior to the compression piston 110 reaching its top dead center position by a discrete phase angle (typically between 10 and 30 crank angle degrees). This phase angle, together with proper timing of the XovrC valve 114 and the XovrE valve 116, enables the split-cycle engine 100 to maintain pressure in the crossover passage 112 at a high minimum pressure (typically 20 bar absolute or higher during full load operation) during all four strokes of its pressure/volume cycle. That is, the split-cycle engine 100 is operable to time the XovrC valve 114 and the XovrE valve 116 such that the XovrC and XovrE valves 114, 116 are both open for a substantial period of time (or period of crankshaft rotation) during which the expansion piston 120 descends from its TDC position towards its BDC position and the compression piston 110 simultaneously ascends from its BDC position towards its TDC position. During the period of time (or crankshaft rotation) that the crossover valves 114, 116 are both open, a substantially equal mass of gas is transferred (1) from the compression cylinder 102 into the crossover passage 112 and (2) from the crossover passage 112 to the expansion cylinder 104. Accordingly, during this period, the pressure in the crossover passage is prevented from dropping below a predetermined minimum pressure (typically 20, 30, or 40 bar absolute during full load operation). Moreover, during a substantial portion of the intake and exhaust strokes (typically 90% of the entire intake and exhaust strokes or greater), the XovrC valve 114 and XovrE valve 116 are both closed to maintain the mass of trapped gas in the crossover passage 112 at a substantially constant level. As a result, the pressure in the crossover passage 112 is maintained at a predetermined minimum pressure during all four strokes of the engine's pressure/volume cycle.

For purposes herein, the method of opening the XovrC 114 and XovrE 116 valves while the expansion piston 120 is descending from TDC and the compression piston 110 is ascending toward TDC in order to simultaneously transfer a substantially equal mass of gas into and out of the crossover passage 112 is referred to herein as the "push-pull" method of gas transfer. It is the push-pull method that enables the pressure in the crossover passage 112 of the engine 100 to be maintained at typically 20 bar or higher during all four strokes of the engine's cycle when the engine is operating at full load.

The crossover valves 114, 116 are actuated by a valve train that includes one or more cams (not shown). In general, a cam-driven mechanism includes a camshaft mechanically linked to the crankshaft. One or more cams are mounted to the camshaft, each having a contoured surface that controls the valve lift profile of the valve event (i.e., the event that occurs during a valve actuation). The XovrC valve 114 and the XovrE valve 116 each can have its own respective cam and/or its own respective camshaft. As the XovrC and XovrE cams rotate, eccentric portions thereof impart motion to a rocker arm, which in turn imparts motion to the valve, thereby lifting (opening) the valve off of its valve seat. As the cam continues to rotate, the eccentric portion passes the rocker arm and the valve is allowed to close.

For purposes herein, a valve event (or valve opening event) is defined as the valve lift from its initial opening off of its valve seat to its closing back onto its valve seat versus rotation of the crankshaft during which the valve lift occurs. Also, for purposes herein, the valve event rate (i.e., the valve actuation rate) is the duration in time required for the valve event to occur within a given engine cycle. It is important to note that a valve event is generally only a fraction of the total duration of an engine operating cycle (e.g., 720 degrees CA for a conventional engine cycle and 360 degrees CA for a split-cycle engine).

The split-cycle air hybrid engine 100 also includes an air reservoir (tank) 142, which is operatively connected to the crossover passage 112 by an air reservoir tank valve 152. Embodiments with two or more crossover passages 112 may include a tank valve 152 for each crossover passage 112, which connect to a common air reservoir 142, or alternatively each crossover passage 112 may operatively connect to separate air reservoirs 142.

The tank valve 152 is typically disposed in an air tank port 154, which extends from the crossover passage 112 to the air tank 142. The air tank port 154 is divided into a first air tank port section 156 and a second air tank port section 158. The first air tank port section 156 connects the air tank valve 152 to the crossover passage 112, and the second air tank port section 158 connects the air tank valve 152 to the air tank 142. The volume of the first air tank port section 156 includes the volume of all additional recesses which connect the tank valve 152 to the crossover passage 112 when the tank valve 152 is closed. Preferably, the volume of the first air tank port section 156 is small relative to the volume of the crossover passage 112 (e.g., less than 25%). More preferably, the first air tank port section 156 is substantially non-existent, that is, the tank valve 152 is most preferably disposed such that it is flush against the outer wall of the crossover passage 112.

The tank valve 152 may be any suitable valve device or system. For example, the tank valve 152 may be a pressure activated check valve, or an active valve which is activated by various valve actuation devices (e.g., pneumatic, hydraulic, cam, electric, or the like). Additionally, the tank valve 152 may comprise a tank valve system with two or more valves actuated with two or more actuation devices.

The air tank 142 is utilized to store energy in the form of compressed air and to later use that compressed air to power the crankshaft 106. This mechanical means for storing potential energy provides numerous potential advantages over the current state of the art. For instance, the split-cycle air hybrid engine 100 can potentially provide many advantages in fuel efficiency gains and NOx emissions reduction at relatively low manufacturing and waste disposal costs in relation to other technologies on the market, such as diesel engines and electric-hybrid systems.

The engine 100 typically runs in a normal operating mode (engine firing (EF) mode or sometimes called the normal firing (NF) mode) and one or more air hybrid modes. In the EF mode, the engine 100 functions normally as previously described in detail herein, operating without the use of the air tank 142. In the EF mode, the air tank valve 152 remains closed to isolate the air tank 142 from the basic split-cycle engine. In the four air hybrid modes, the engine 100 operates with the use of the air tank 142.

Exemplary air hybrid modes include:

1) Air Expander (AE) mode, which includes using compressed air energy from the air tank 142 without combustion;

2) Air Compressor (AC) mode, which includes storing compressed air energy into the air tank 142 without combustion;

3) Air Expander and Firing (AEF) mode, which includes using compressed air energy from the air tank 142 with combustion; and 4) Firing and Charging (FC) mode, which includes storing compressed air energy into the air tank 142 with combustion.

Further details on split-cycle engines can be found in U.S. Pat. No. 6,543,225 entitled Split Four Stroke Cycle Internal Combustion Engine and issued on Apr. 8, 2003; and U.S. Pat. No. 6,952,923 entitled Split-Cycle Four-Stroke Engine and issued on Oct. 11, 2005, each of which is incorporated by reference herein in its entirety.

Further details on air hybrid engines are disclosed in U.S. Pat. No. 7,353,786 entitled Split-Cycle Air Hybrid Engine and issued on Apr. 8, 2008; U.S. Patent Application No. 61/365,343 entitled Split-Cycle Air Hybrid Engine and filed on Jul. 18, 2010; and U.S. Patent Application No. 61/313,831 entitled Split-Cycle Air Hybrid Engine and filed on Mar. 15, 2010, each of which is incorporated by reference herein in its entirety.

SUMMARY

Devices and related methods are disclosed that generally involve the selective deactivation of one or more engine valves. In one embodiment, a split-cycle internal combustion engine is provided in which a high-speed trigger valve is used to fill and drain a hydraulic tappet that forms part of a lost-motion system of an engine valve. A spool valve can be used to selectively disconnect the tappet from the trigger valve, thereby deactivating the associated engine valve (i.e., preventing the engine valve from opening). The devices and methods disclosed herein also have application in conventional internal combustion engines and can be used with inwardly-opening and/or outwardly-opening valves.

In one aspect of at least one embodiment of the invention, a split-cycle engine is provided that includes a first crossover inlet valve and a first crossover outlet valve. At least one valve selected from the group consisting of the first crossover inlet valve and the first crossover outlet valve can be selectively deactivated.

In another aspect of at least one embodiment of the invention, a method of controlling an engine valve is provided. The method includes activating the engine valve by positioning a spool valve such that an adjustable hydraulic tappet operatively coupled to the engine valve is in fluid communication with a trigger valve, the trigger valve controlling fluid flow into and out of the tappet. The method also includes deactivating the engine valve by positioning the spool valve such that the tappet is hydraulically disconnected from the trigger valve.

In another aspect of at least one embodiment of the invention, a valve actuation system is provided that includes a bearing element coupled to an adjustable hydraulic tappet and a cam configured to impart motion to the bearing element and thereby rotate a rocker arm when the bearing element is positioned between an eccentric portion of the cam and a rocker pad formed on the rocker arm. The system also includes an engine valve coupled to the rocker arm such that rotation of the rocker arm in a first direction is effective to open the engine valve and rotation of the rocker arm in a second direction opposite from the first direction is effective to close the engine valve. The system also includes a trigger valve that allows the adjustable hydraulic tappet to be selectively drained of and filled with hydraulic fluid such that a position of the bearing element can be adjusted and a spool valve having a first configuration in which the adjustable hydraulic tappet is placed in fluid communication with the trigger valve such that the engine valve is activated and a second configuration in which the adjustable hydraulic tappet is hydraulically disconnected from the trigger valve and is instead placed in fluid communication with a hydraulic accumulator such that the engine valve is deactivated. The system also includes a solenoid configured to selectively place the spool valve in the first configuration or the second configuration.

The present invention further provides devices, systems, and methods as claimed.

BRIEF DESCRIPTION OF THE DRAWINGS

The invention will be more fully understood from the following detailed description taken in conjunction with the accompanying drawings, in which.

DETAILED DESCRIPTION

Certain exemplary embodiments will now be described to provide an overall understanding of the principles of the structure, function, manufacture, and use of the devices and methods disclosed herein. One or more examples of these embodiments are illustrated in the accompanying drawings. Those skilled in the art will understand that the devices and methods specifically described herein and illustrated in the accompanying drawings are non-limiting exemplary embodiments and that the scope of the present invention is defined solely by the claims. The features illustrated or described in connection with one exemplary embodiment may be combined with the features of other embodiments. Such modifications and variations are intended to be included within the scope of the present invention.

Although certain methods and devices are disclosed herein in the context of a split-cycle engine and/or an air hybrid engine, a person having ordinary skill in the art will appreciate that the methods and devices disclosed herein can be used in any of a variety of contexts, including, without limitation, non-hybrid engines, two-stroke and four-stroke engines, conventional engines, diesel engines, etc.

In order to operate the engines disclosed herein at maximum efficiency, it is desirable to vary the opening parameters of the various engine valves, and, in some cases, to deactivate one or more of the valves. As used herein, "deactivating" a valve includes actively holding the valve in a closed position and/or preventing the valve from opening. Valve deactivation is particularly advantageous in engines that include a plurality of crossover passages or a plurality of inlet and/or outlet valves within a single crossover passage. For example, when the engine is operating at a low speed or under a low load, one or more valves can be deactivated so that the engine operates on only a single crossover passage, or using only a single set of crossover valves. This reduces parasitic losses experienced by the engine, increases compression ratios, and improves operating stability and efficiency.

Figure 1:
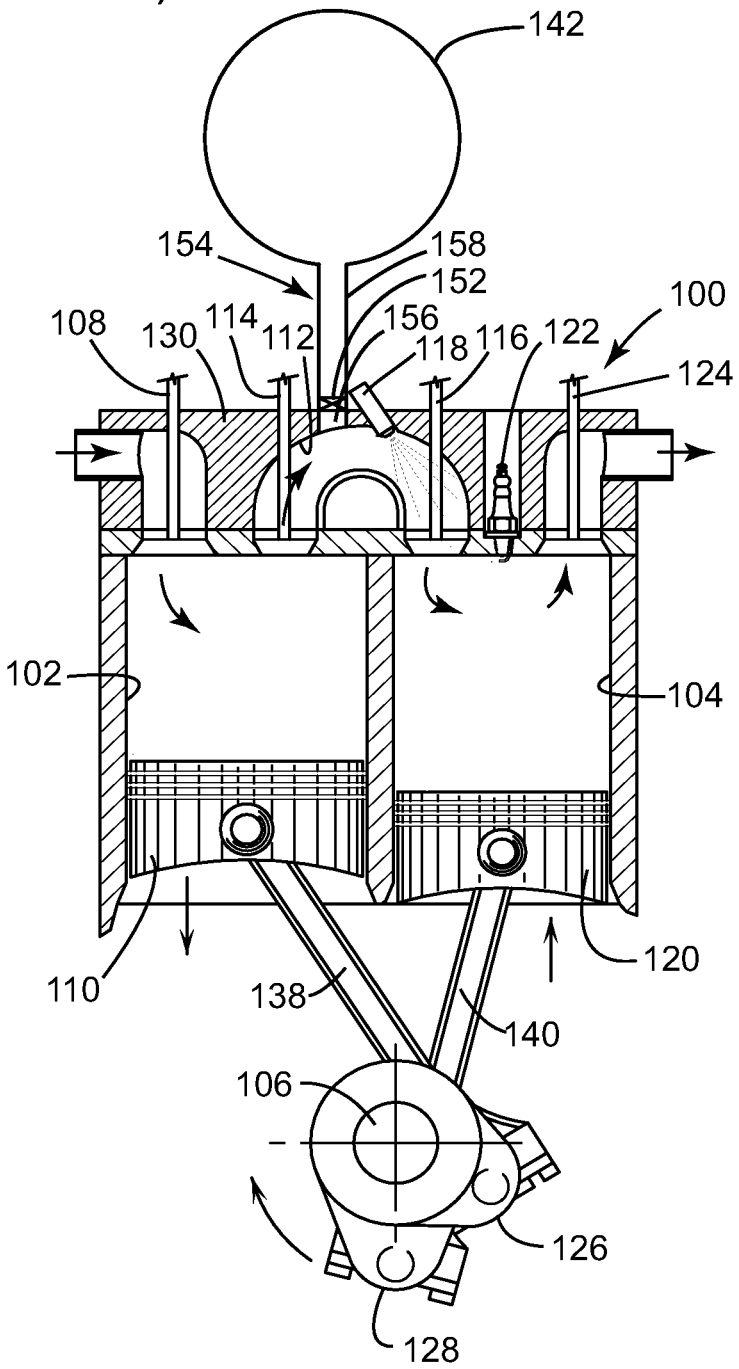
FIG. 1 (Prior Art)
FIG. 1 is a schematic cross-sectional view of one embodiment of a prior art split-cycle air hybrid engine according to the present invention.
Figure 2A:
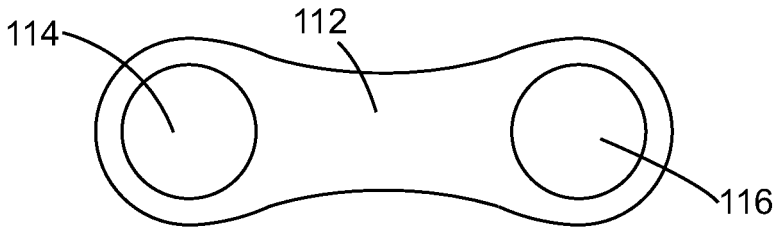
FIG. 2A is a schematic cross-sectional view of one embodiment of a crossover passage of a split-cycle engine according to the present invention.
Figure 2B:
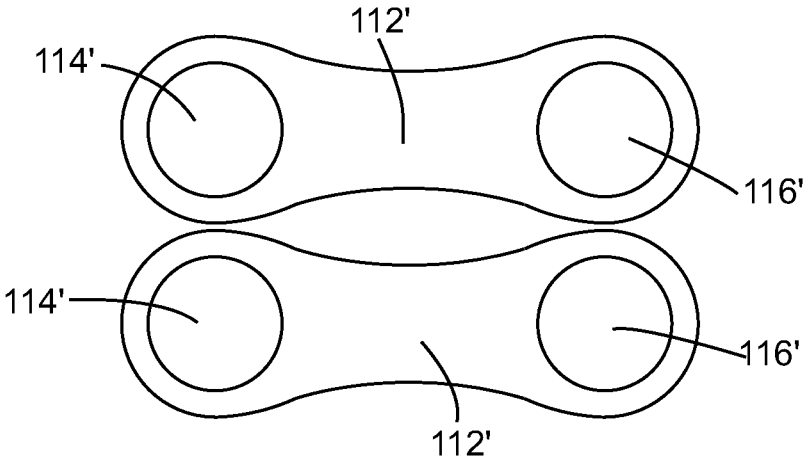
FIG. 2B is a schematic cross-sectional view of another embodiment of a crossover passage of a split-cycle engine according to the present invention.
Figure 2C:
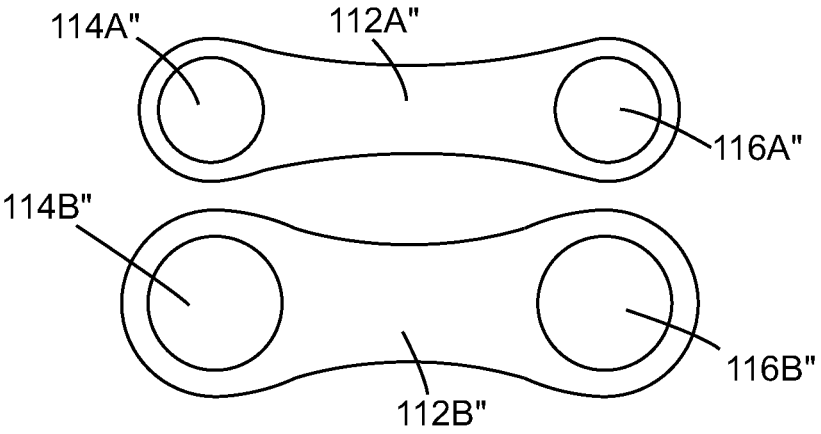
FIG. 2C is a schematic cross-sectional view of another embodiment of a crossover passage of a split-cycle engine according to the present invention.

FIGS. 2A-2C illustrate various configurations of crossover passages and associated valves. FIG. 2A illustrates a cross-sectional view of the crossover passage 112 of FIG. 1 from above. As shown, an inlet of the crossover passage is selectively opened and closed by actuating the XovrC valve 114. Likewise, an outlet of the crossover passage 112 is selectively opened and closed by actuating the XovrE valve 116. FIG. 2B illustrates another embodiment of a split-cycle engine in which a plurality of crossover passages 112' are provided. Each crossover passage 112' includes its own respective XovrC valve 114' and XovrE valve 116'. FIG. 2C illustrates yet another embodiment of a split-cycle engine in which a plurality of crossover passages 112A", 112B" are provided having a plurality of passage sizes for various load range requirements. In the illustrated embodiment, the respectively smaller crossover passage 112A", with its associated smaller XovrC and XovrE valves 114A", 116A", would be used for the lower portion of a predetermined load range. Additionally, the respectively larger crossover passage 112B", with its associated larger XovrC and XovrE valves 114B", 116B", would be used for the intermediate portion of that predetermined load range. Finally, the two crossover passages 112A", 112B" combined would be used for the upper portion of the same predetermined load range.

Figure 3A:
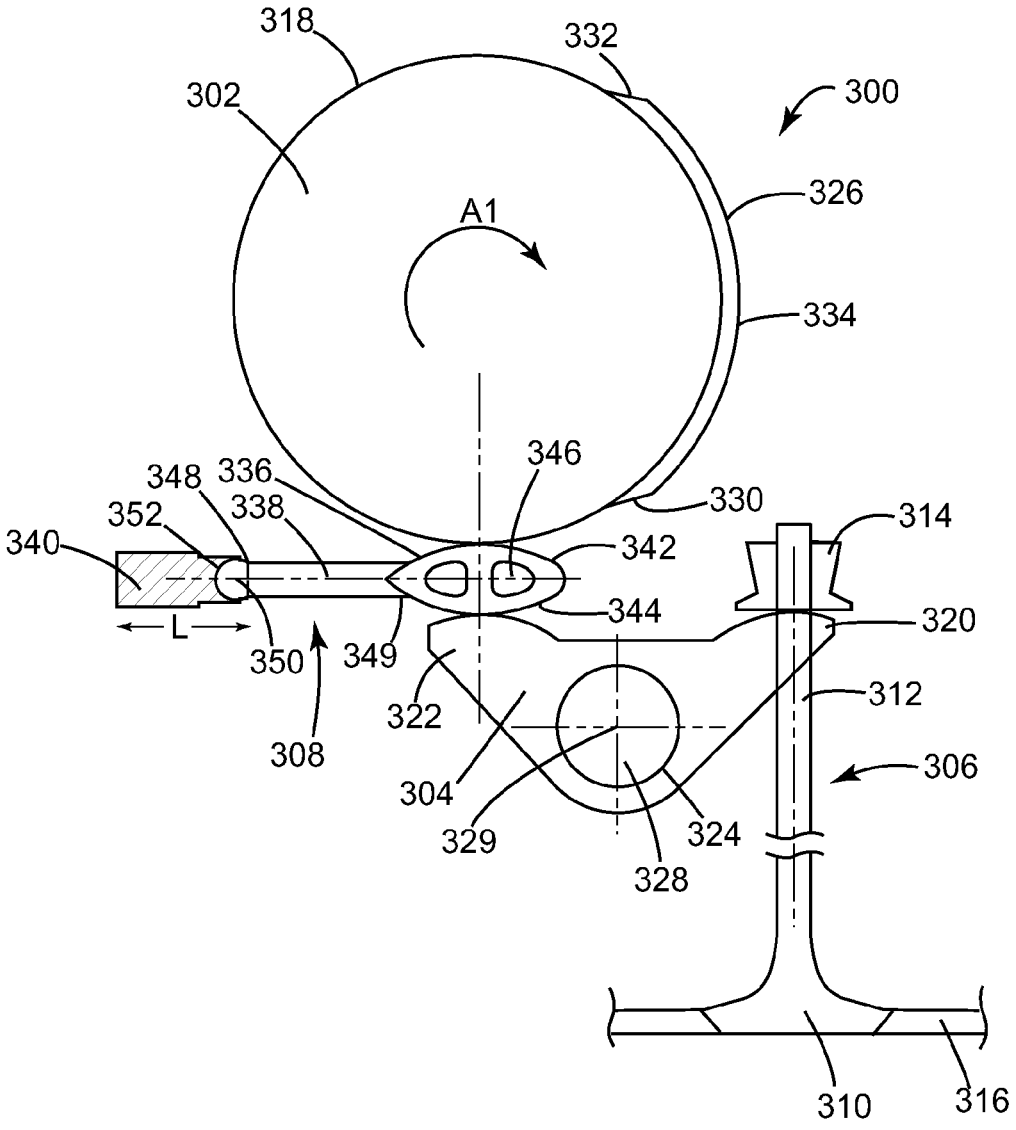
FIG. 3A is a schematic view of one embodiment of a valve train according to the present invention in which a valve is closed.
Figure 3B:
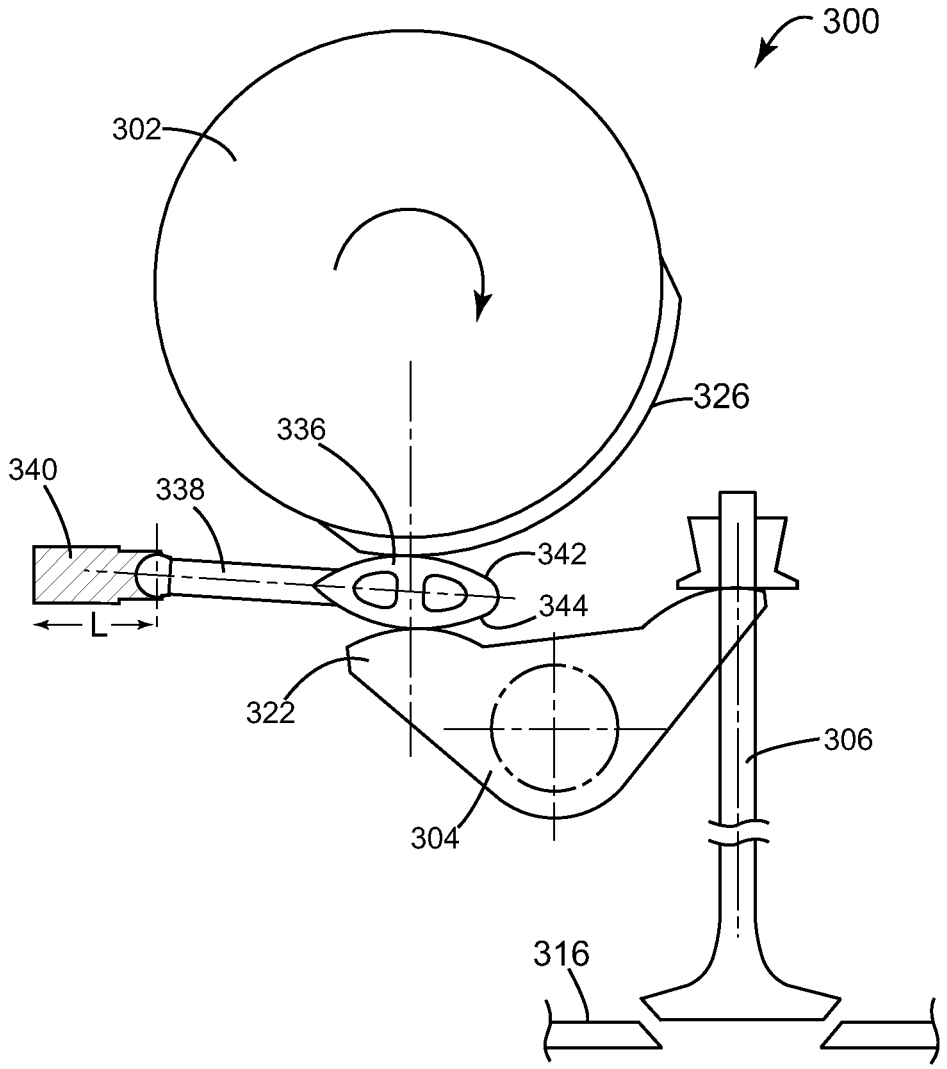
FIG. 3B is a schematic view of the valve train of FIG. 3A in which the valve is opened.
Figure 3C:
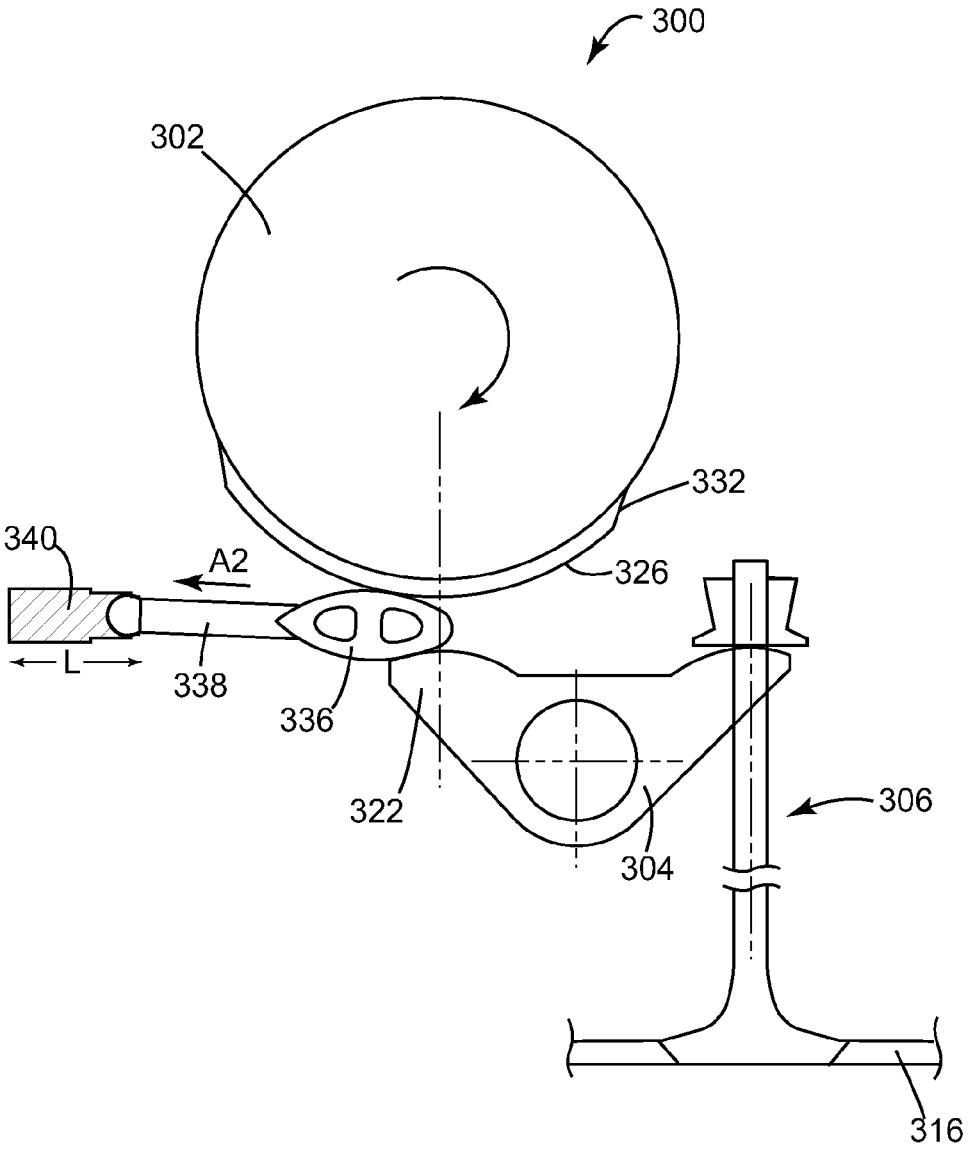
FIG. 3C is a schematic view of the valve train of FIGS. 3A and 3B in which the valve is closed earlier than what is called for by a profile of a cam.

FIGS. 3A-3C illustrate one exemplary embodiment of a valve train suitable for adjusting a variety of engine valve parameters (i.e., modifying the valve motion proscribed by a cam profile so as to vary the valve's opening timing, opening rate, opening duration, etc.). It will be appreciated that the illustrated valve train is only one exemplary embodiment, and that any of a variety of valve trains can be used without departing from the scope of the present invention. The illustrated valve train is particularly useful in split-cycle engines which ignite their charge after the expansion piston reaches its TDC position. In these engines, the dynamic actuation of the crossover valves (i.e., 114, 116) is very demanding. This is because the crossover valves must generally achieve sufficient lift to fully transfer the fuel-air charge in a very short period of crankshaft rotation (typically in a range of about 30 to 60 degrees CA) relative to that of a conventional engine, which normally actuates the valves for a period of approximately 180 degrees CA. As a result, the crossover valves are required to actuate about four to six times faster than the valves of a conventional engine. Thus, the valve train must be capable of relatively fast actuation rates. The illustrated valve train can be used to actuate any of the valves of an engine including without limitation XovrC and XovrE crossover valves of a split-cycle engine.

As shown in FIG. 3A, the valve train 300 generally includes a cam 302, a rocker 304, a valve 306, and an adjustable mechanical element 308. The valve train 300 also includes one or more associated support elements, which for purposes of brevity are not illustrated.

The valve 306 includes a valve head 310 and a valve stem 312 extending vertically from the valve head 310. A valve adapter assembly 314 is disposed at the tip of the stem 312 opposite the head 310 and is securely fixed thereto. A valve spring (not shown) holds the valve head 310 securely against a valve seat 316 when the valve 306 is in its closed position. Any of a variety of valve springs can be used for this purpose, including, for example, air or gas springs. In addition, although the illustrated valve 306 is an outwardly-opening poppet valve, any cam-actuated valve can be used, including inwardly-opening poppet valves, without departing from the scope of the present invention.

The rocker 304 includes a forked rocker pad 320 at one end, which straddles the valve stem 312 and engages the underside of the valve adapter assembly 314. Additionally, the rocker 304 includes a solid rocker pad 322 at an opposing end, which slidably contacts the adjustable mechanical element 308. The rocker 304 also includes a rocker shaft bore 324 extending therethrough. The rocker shaft bore 324 is disposed over a supporting rocker shaft 328 such that the rocker 304 rotates on the rocker shaft 328 about an axis of rotation 329.

The forked rocker pad 320 of the rocker 304 contacts the valve adapter assembly 314 of the outwardly-opening poppet valve 306 such that a downward direction of the rocker pad 322 caused by the actuation of the cam 302 and adjustable mechanical element 308 translates into an upward movement of the rocker pad 320, which in turn opens the valve 306. The geometry of the rocker 304 is selected to achieve a desired ratio of the distance between the forked rocker pad 320 and the axis of the rocker rotation 329 to the distance between the rocker pad 322 and the axis of rocker rotation 329. In one embodiment, this ratio can be between about 1:1 and about 2:1, and preferably about 1.3:1, about 1.4:1, about 1.5:1, about 1.6:1, or about 1.7:1.

The cam 302 is a "dwell cam," which as used herein is a cam that includes a dwell section (i.e., a section of the eccentric portion of the cam having a constant radius) of at least 5 degrees CA. In the illustrated embodiment, the dwell cam 302 rotates clockwise (in the direction of the arrow A1). The dwell cam 302 generally includes a base circle portion 318 and an eccentric portion 326. As the eccentric portion 326 of the cam 302 contacts the adjustable mechanical element 308, the adjustable mechanical element pivots, which then causes the rocker 304 to rotate about the rocker shaft 328 to lift the valve 306 off of its seat 316.

The eccentric portion 326 comprises an opening ramp 330, a closing ramp 332, and a dwell section 334. The dwell section 334 can be of various sizes, (e.g., at least 5 degrees CA) and in the illustrated embodiment, is sized to match the longest possible valve event duration (i.e., maximum valve event) needed over a full range of engine operating conditions and/or air hybrid modes. The opening ramp 330 of the cam 302 is contoured to a shape that adequately achieves the desired lift of the engine valve 306 at the desired rate. The closing ramp 332 (or "landing" ramp) is shaped to rapidly decelerate the velocity of the valve 306 as it approaches the valve seat 316. Further detail on dwell cams can be found in U.S. application Ser. No. 13/359,525, filed on an even date herewith, entitled "SPLIT-CYCLE AIR HYBRID ENGINE WITH DWELL CAM," which is hereby incorporated by reference in its entirety.

The adjustable mechanical element 308 is used to selectively vary the lift and the opening and closing parameters of the valve 306. In the embodiment of FIGS. 3A-3C, the adjustable mechanical element 308 includes a bearing element 336, a connecting arm 338, and an adjustable hydraulic tappet 340.

As shown, the bearing element 336 has a generally elliptical-shaped cross-section defined by opposed first and second bearing surfaces 342, 344, each having a generally convex profile. The bearing element 336 is selectively positioned between the cam 302 and the rocker 304 such that the first bearing surface 342 slidably engages the cam 302 and the second bearing surface 344 slidably engages the rocker pad 322. The bearing element 336 has one or more cavities 346 formed therein, for example, to reduce the overall mass of the bearing element 336 and thus facilitate faster actuation.

The bearing element 336 is coupled to the adjustable hydraulic tappet 340 via at least one connecting arm 338. The connecting arm 338 in the illustrated embodiment is a generally cylindrical arm having a proximal end 348 and a distal end 349. The distal end 349 of the connecting arm 338 is coupled to the bearing element 336 while the proximal end 348 of the connecting arm 338 is coupled to the tappet 340.

The connecting arm 338 can be mated to the tappet 340 and to the bearing element 336 in a variety of ways. For example, the connecting arm 338 can be fixedly mated to the tappet 340 and/or the bearing element 336 with, for example, a screw, bolt, snap-fit engagement, etc., can be formed integrally with the tappet 340 and/or the bearing element 336, or can be pivotally mated to either or both of the tappet 340 and the bearing element 336. In the illustrated embodiment, the connecting arm 338 is formed integrally with the bearing element 336. The proximal end 348 of the connecting arm 338 has a generally spherical ball 350 formed thereon. The ball 350 is sized and otherwise configured to be received by a corresponding socket 352 formed in a distal end of the tappet 340, such that the connecting arm 338 is pivotable with respect to the tappet 340. In other words, the connecting arm 338 is free to rotate about a plurality of rotational axes substantially transverse to a longitudinal axis of the tappet 340. The connecting arm 338 can also be mated to the tappet 340 such that it rotates about a pivot pin, axle, or other coupling. Although the bearing element 336 is formed integrally with the connecting arm 338 in the illustrated embodiment, it can also be pivotally coupled thereto using any of the techniques described above for mating the connecting arm 338 to the tappet 340.

The tappet 340 is adjustable such that the connecting arm 338 and the bearing element 336 coupled thereto can be selectively advanced towards or retracted from the cam 302 and rocker 304 (i.e., in a lateral direction).

In one embodiment, the tappet 340 is configured to exert both a pulling force and a pushing force on the connecting arm 338 and the bearing element 336. For example, the tappet 340 can define an internal cavity in which a piston is slidably received. The piston forms a seal with the inner surface of the cavity such that first and second fluid chambers are defined thereby, one on each side of the piston. The piston is operatively coupled to the socket 352 and/or the connecting arm 338 such that linear motion of the piston imparts a corresponding linear motion to the connecting arm. The first and second fluid chambers defined within the tappet 340 are selectively filled with and drained of a hydraulic fluid to move the piston (and thus the bearing element 336) towards or away from the cam 302 and the rocker 304.

Alternatively, the tappet 340 can be configured only to exert a pushing force on the bearing element 336, in which case forces supplied by the cam, the rocker, and/or one or more bias springs are used to force the bearing element 336 into a retracted position. For example, the tappet 340 can include first and second cylindrical telescoping halves defining a fluid chamber between the respective interiors thereof. As will be described below, the tappet is actuated by a fluid control system. When the tappet 340 is actuated, fluid is displaced from the fluid chamber, allowing the first and second telescoping halves to slide relative to and towards one another, thereby reducing the overall length L of the tappet 340. The fluid control system is configured to maintain hydraulic fluid within the tappet 340, such that the length L of the tappet 340 remains substantially constant. The fluid control system is also configured to partially or completely drain the tappet 340 of fluid, allowing the tappet 340 to partially or fully collapse, thus reducing the length L thereof. The fluid control system also selectively refills the tappet 340, causing it to expand linearly such that the overall length L thereof is increased.

Although the illustrated embodiment includes a hydraulic tappet 340 to advance and/or retract the connecting arm 338 and the bearing element 336, a variety of other mechanisms can be employed for this purpose without departing from the scope of the present invention. For example, pneumatic, mechanical, electrical, and/or electromagnetic actuators can be used to impart motion to the connecting arm 338 and/or bearing element 336.

In operation, the cam 302 rotates clockwise as a camshaft to which it is mounted is driven by rotation of the engine's crankshaft. As shown in FIG. 3A, when the base circle portion 318 of the cam 302 engages the bearing element 336, the rocker 304 remains in a "fully closed" position in which the forked rocker pad 320 does not apply sufficient lifting force to the valve 306 to overcome the bias of the valve spring, and therefore the valve 306 remains closed. In the illustrated embodiment, the thickness of the bearing element 336 and the spacing between the cam 302 and rocker 304 are sized such that even when the thickest portion of the bearing element 336 is positioned between the base circle portion 318 of the cam 302 and the rocker 304, the valve 306 remains closed.

As shown in FIG. 3B, the eccentric portion 326 of the cam 302 engages the first bearing surface 342 of the bearing element 336 during a portion of the cam's rotation. The eccentric portion 326 imparts a downward motion to the bearing element 336, causing the connecting arm 338 to pivot in a clockwise direction about the distal end of the tappet 340. As the connecting arm 338 pivots, some or all of the downward motion of the bearing element 336 is imparted to the rocker 304, which engages the second bearing surface 344 of the bearing element 336. This results in a counter-clockwise rotation of the rocker 304, which in turn is effective to lift the valve 306 off of the seat 316. Because the bearing surfaces 342, 344 are curved such that the bearing element 336 has a variable thickness along a length thereof, the degree to which the valve 306 is lifted is controlled by varying the degree to which the bearing element 336 is inserted between the cam 302 and the rocker 304. For example, in FIG. 3B, the bearing element 336 is inserted such that the thickest portion thereof is disposed between the thickest portion of the rocker pad 322 and the cam 302, thereby imparting maximum lift to the valve 306. A reduced valve lift is achieved by withdrawing the bearing element 336 slightly in the direction of the tappet 340. In FIG. 3B, the fluid control system maintains a specified amount of hydraulic fluid within the tappet 340 such that the length L thereof remains substantially constant and some or all of the motion imparted to the bearing element 336 is transferred to the valve 306, lifting it off of the seat 316. In other words, with the tappet 340 maintained at a constant length, the motion of the valve 306 will substantially mirror the profile of the cam 302.

As shown in FIG. 3C, the valve train 300 is capable of closing the valve before the closing ramp 332 of the cam 302 reaches the bearing element 336, and is capable of reducing the degree to which the valve 306 is opened. For example, the fluid control system can allow a sudden release of hydraulic fluid from the fluid chamber of the tappet 340. When the fluid is allowed to escape the tappet 340, a squeezing force acting on the bearing element 336 in the direction of the arrow A2 is effective to push the bearing element 336 away from the cam 302 and the rocker 304, compressing or collapsing the tappet 340 and forcing hydraulic fluid therefrom. The squeezing force is generated by the combined force of the valve spring biasing the rocker arm 304 in a clockwise direction, coupled with the force of the cam's eccentric portion 326 rotating against the bearing element 336 in a clockwise direction. It will be appreciated that the squeezing force is only a minor component of the force acting on the bearing element 336, and that the bearing element 336 is shaped such that the majority of the force of the cam 302 is applied downwards onto the rocker pad 322 and vice versa. It will also be appreciated that the degree to which the bearing element 336 is forced out from between the cam 302 and the rocker 304, and thus the degree to which the valve 306 is allowed to close, can be controlled by adjusting the degree to which hydraulic fluid is permitted to escape from the tappet 340. In other words, the fluid control system can briefly allow fluid to escape from the tappet 340 and then again maintain the level of fluid in the tappet 340 such that it will only collapse to a degree corresponding to the amount of fluid displaced from the fluid chamber, in which case the valve 306 will only partially close. This is desirable when it is necessary to adjust the lift height of the valve 306. Alternatively, the fluid control system can allow the tappet 340 to compress far enough to allow the valve 306 to fully close.

In embodiments in which the tappet 340 is configured to both push and pull the connecting arm 338 and bearing element 336, the tappet 340 can be controlled to actively pull the bearing element 336 away from the cam 302 and the rocker 304, instead of relying on the aforementioned squeezing force.

In FIG. 3C, the bearing element 336 is shown withdrawn far enough from the cam 302 and the rocker 304 such that insufficient motion is imparted from the eccentric portion 336 of the cam 302 to the rocker 304 for the valve 306 to actually be lifted off of the seat 316, and thus the valve 306 closes or remains closed. The valve train 300 thus provides a lost-motion feature that allows for variable valve actuation (i.e., permits the valve 306 to close at an earlier time than that provided by the profile of the cam 302). Furthermore, the valve train 300 permits the lift of the valve 306 to be varied, for example, by varying the degree to which fluid is drained from the tappet 340 and thus the degree to which the valve is allowed to open or close. The valve train 300 is thus configured to transmit all of the cam motion to the valve 306, to transmit only a portion of the cam motion to the valve 306, or to transmit none of the cam motion to the valve 306.

It will be appreciated that the valve 306 can be deactivated entirely by maintaining the bearing element 336 in the position shown in FIG. 3C throughout the cam's rotation. In other words, if the tappet 340 is maintained in a reduced-length configuration such that the bearing element 336 is sufficiently withdrawn from between the cam 302 and the rocker 304, none of the cam's motion will be imparted to the valve 306 and the valve 306 will remain closed.

Further detail on valve trains that incorporate a variable valve actuation function and/or a lost-motion function can be found in U.S. application Ser. No. 13/359,521, filed on an even date herewith, entitled "LOST-MOTION VARIABLE VALVE ACTUATION SYSTEM WITH CAM PHASER," which is hereby incorporated by reference in its entirety.

Figure 4A:
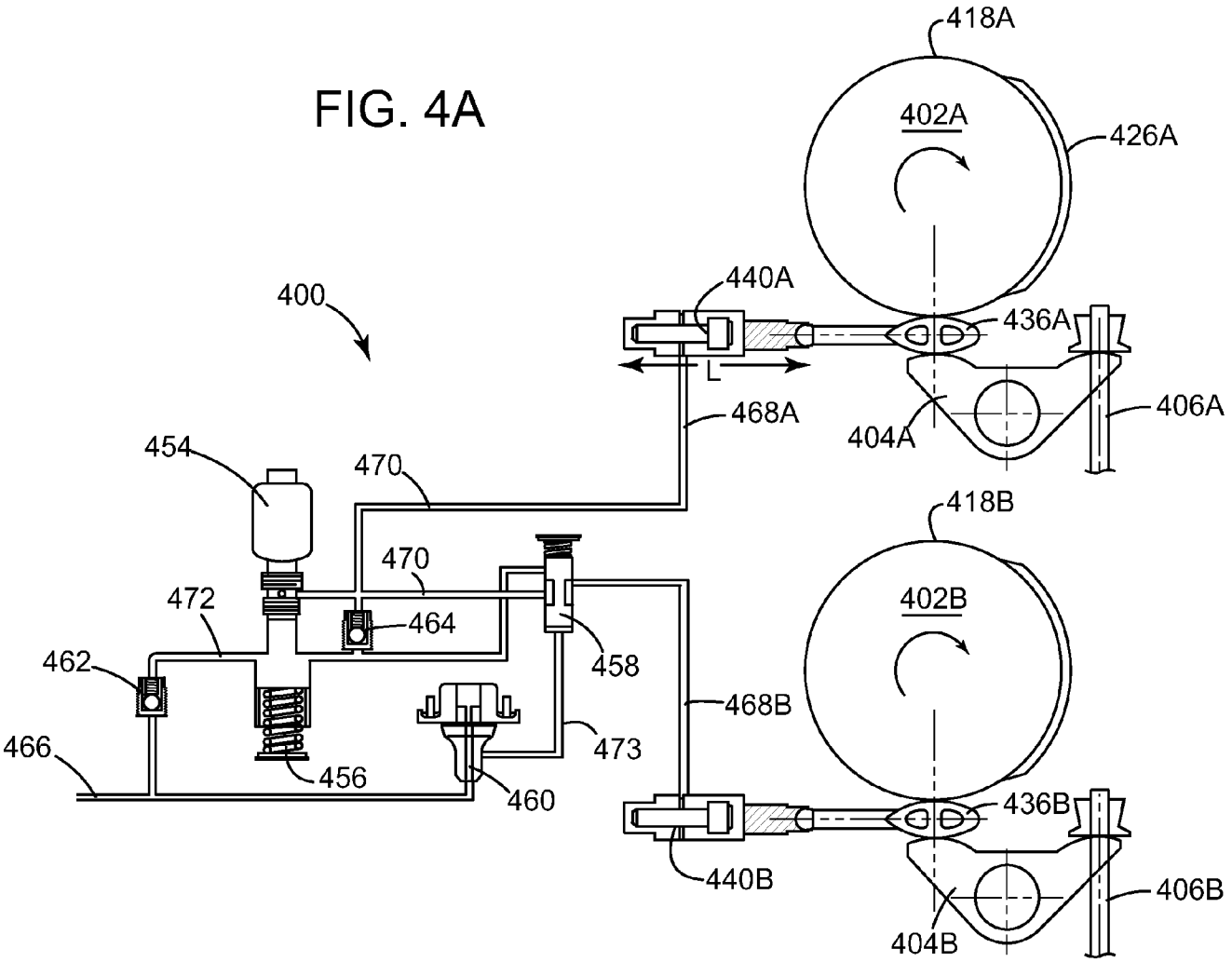
FIG. 4A is a schematic view of one embodiment of a valve deactivation system according to the present invention in which an engine valve is activated.
Figure 4B:
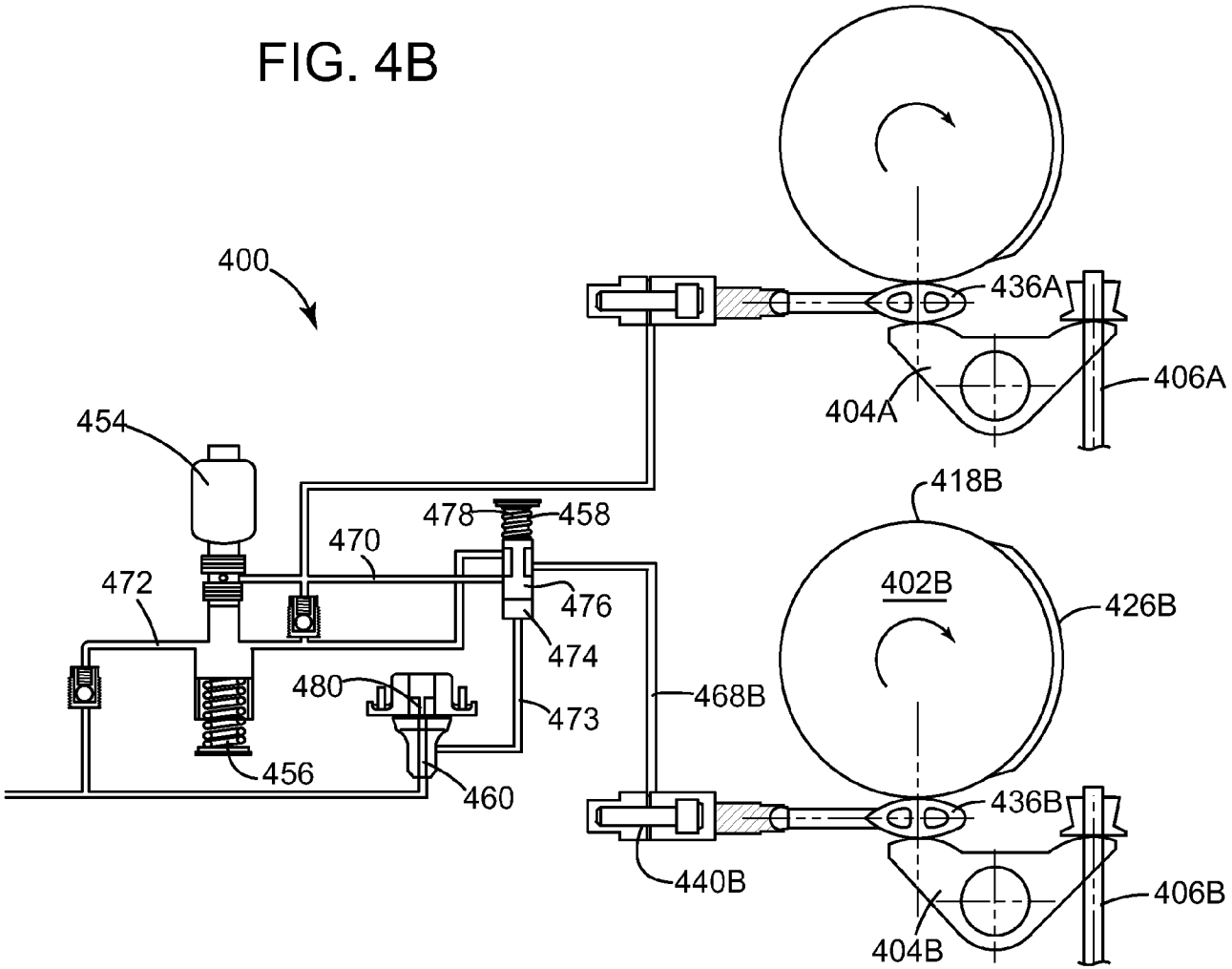
FIG. 4B is a schematic view of the valve deactivation system of FIG. 4A in which the engine valve is deactivated.

FIGS. 4A-4B illustrate one embodiment of a valve deactivation and fluid control system 400 for actuating first and second engine valves 406A, 406B. The valves 406A, 406B can be intake valves, exhaust valves, and/or crossover valves and can be inwardly-opening valves or outwardly-opening valves. In one embodiment, the valve 406A is an outwardly-opening XovrC valve controlling air flow between a compression cylinder and a first crossover passage, and the valve 406B is an outwardly-opening XovrC valve controlling air flow between a compression cylinder and a second crossover passage.

The system 400 includes a high speed trigger valve 454, a hydraulic spring-loaded accumulator 456, and a spool valve 458 actuated by a valve deactivation solenoid valve 460. One or more check valves 462, 464 are also included in the system 400. A hydraulic input line 466 is placed in fluid communication with a supply of hydraulic fluid (i.e., the engine oil supply). First and second tappet output lines 468A, 468B are placed in fluid communication with respective adjustable hydraulic tappets 440A, 440B which are in turn coupled to the respective valve trains of the first and second engine valves 406A, 406B.

In operation, the spool valve 458 is selectively moved between at least two positions. In an "activated" position, the engine valve 406B coupled to the second tappet 440B is allowed to open and close as called for by the cam (or as called for by the associated lost-motion system). In the "deactivated" position, the engine valve 406B is maintained in a closed position.

FIG. 4A illustrates the operation of the system 400 when the spool valve 458 is in the "activated" position. In this configuration, hydraulic fluid supplied via the input line 466 flows through the check valve 462 and into a fluid chamber 472 coupled to the trigger valve 454 and to the accumulator 456. While a spring-loaded accumulator 456 is shown in the illustrated embodiment, any type of low pressure source can be employed without departing from the scope of the present invention. The check valve 462 advantageously isolates the fluid chamber 472 from the hydraulic fluid supply and thus permits the accumulator 456 to supply a greater pressure than the supply pressure. The accumulator 456 exerts a force on the hydraulic fluid in the fluid chamber 472, forcing the fluid against the inlet of the trigger valve 454.

When one or both of the bearing elements 436A, 436B are in contact with the base circle portions 418A, 418B of the cams 402A, 402B, oil flows from the accumulator through the check valve 464 and the trigger valve 454 (if it is open), into an outlet line 470, and ultimately into the tappets 440A, 440B, thereby expanding the length L thereof. At some point after the tappets 440A, 440B are partially or completely filled (i.e., before the eccentric portion 426A of the cam 402A contacts the bearing element 436A in the case of the system that actuates the engine valve 406A), the trigger valve 454 is closed to lock the volume of hydraulic fluid in the trigger valve output line 470 and the tappet 440A. Since the hydraulic fluid is relatively incompressible, the tappet 440A will maintain its length even when the eccentric portion 426A of the cam 402A bears against the bearing element 436A to rotate the rocker 404A in a counter-clockwise direction, thereby opening the engine valve 406A. If it is desired to close the engine valve 406A earlier than what the cam 402A calls for (i.e., while the bearing element 436A is still in contact with the eccentric portion 426A of the cam 402A), the trigger valve 454 is opened. The force applied to the bearing element 436A by the cam 402A and the engine valve spring (not shown) at this time is sufficient to partially or fully collapse the tappet 440A, thereby forcing hydraulic fluid out of the tappet 440A and back through the trigger valve 454 and into the accumulator 456. In other words, the forces that expel the fluid from the tappet 440A are greater than a force required to compress the spring of the accumulator 456, such that fluid flows out of the tappet 440A and into the accumulator 456.

Alternatively, the trigger valve 454 can remain closed throughout the cam's rotation such that the bearing element 436A acts like a solid lifter and the engine valve 406A opens and closes according to the cam's profile.

The tappet 440A can be refilled in the event that it is ever partially or fully drained. For example, once the eccentric portion 426A of the cam 402A rotates past the bearing element 436A, the force applied thereby is substantially removed from the bearing element 436A, and the force supplied by the accumulator 456 to the fluid in the fluid chamber 472 is sufficient to refill and expand the tappet 440A. The check valve 464 can provide a fluid path to bypass the trigger valve 454, or augment the flow through the trigger valve 454, during refill of the tappet 440A, thereby increasing the overall rate of flow to the tappet.

When the spool valve 458 is configured as shown in FIG. 4A, the second tappet 440B operates in substantially the same way as the first tappet 440A. In particular, because the spool valve 458 is positioned to allow fluid to flow between the trigger valve output line 470 and the second tappet output line 468B, the trigger valve 454 can selectively disconnect (i.e., by opening and closing) the second tappet supply line 468B from the accumulator 456 in much the same way as with the first tappet supply line 468A.

When the spool valve 458 is configured as shown in FIG. 4B, however, the second engine valve 406B is deactivated. In this configuration, the spool valve 458 blocks fluid communication between the trigger valve output line 470 and the second tappet output line 468B. Instead, the spool valve 458 places the second tappet output line 468B in fluid communication with the fluid chamber 472. Thus, regardless of the state of the trigger valve 454, the second tappet 440B is in fluid communication with the accumulator 456, which supplies a relatively weak force on the hydraulic fluid in the tappet 440B compared to the forces exerted thereon by the valve train. Thus, in this position, the tappet 440B fills under the pressure of the accumulator 456 when the bearing element 436B is in contact with the base circle portion 418B of the cam 402B, but will immediately begin to drain as the eccentric portion 426B of the cam 402B engages the bearing element 436B. Since the tappet 440B does not stay filled during the lift portion of the cam 402B, the engine valve 406B remains closed throughout the cam's rotation and is thus "deactivated." It will be appreciated that the filling and/or draining of the tappet 440B that occurs while the engine valve 406B is deactivated advantageously keeps the various valve train components (i.e., the bearing element 436B, the rocker 404B, and the cam 402B) in substantially constant contact with each other. This prevents the excessive forces that are generated when valve train components regain contact, thereby preventing damage to the engine.

The configuration of the spool valve 458 can be changed using any of a variety of techniques. In the illustrated embodiment, a valve deactivation solenoid 460 is provided to change the configuration of the spool valve 458. As shown, the spool valve 458 generally comprises a fluid cylinder 474 with a spool 476 reciprocally disposed therein. A bias spring 478 biases the spool 476 towards the bottom of the cylinder 474 (i.e., to a valve "activated" position). When the valve deactivation solenoid 460 is energized, hydraulic fluid is supplied to the cylinder 474 to move the spool 476 upwards against the bias spring 478 and to place the spool valve 458 in the "deactivated" position. When the solenoid 460 is de-energized, the cylinder 474 is coupled to drain so that the bias spring 478 moves the spool 476 downwards into the "activated" position. The solenoid pin 480 can also be directly coupled to the spool 476, in which case linear movement of the solenoid pin results in an identical linear motion of the spool 476. The valve deactivation solenoid 460 can be configured to control deactivation of multiple engine valves 406 by connecting the solenoid output line 473 to multiple spool valves 458, each spool valve corresponding to a respective engine valve.

The illustrated system 400 can thus selectively de-activate the second engine valve 406B without affecting the operation of the first engine valve 406A. In the illustrated embodiment, a single high-speed trigger valve 454 is used in conjunction with a comparatively low-speed solenoid 460 and spool valve 458 to accomplish the selective deactivation of the valve 406B for one or more engine valve pairs. It will be appreciated that by using this system, instead of one in which each valve 406A, 406B has its own associated high-speed trigger valve, considerable advantages are obtained. For example, the overall size and cost of the engine is decreased by using smaller and less expensive solenoid valves instead of independent high-speed trigger valves. In addition, since the power required to actuate the solenoid valve is less than that required to actuate the high-speed trigger valve, the overall parasitic losses of the engine are reduced.

Notwithstanding these advantages, in one embodiment, the valve deactivation solenoid 460 and the spool valve 458 are omitted in favor of a second trigger valve, in which case the second engine valve 406B is actuated in substantially the same manner as the first engine valve 406A described above. In such embodiments, one or both of the engine valves can be independently deactivated by simply holding the engine valve's associated trigger valve in an open position.

The engines and valve trains disclosed herein are configured to operate reliably over a broad range of engine speeds. In certain embodiments, engines and valve trains according to the present invention are capable of operating at a speed of at least about 4000 rpm, and preferably at least about 5000 rpm, and more preferably at least about 7000 rpm.

Although the invention has been described by reference to specific embodiments, it should be understood that numerous changes may be made within the spirit and scope of the inventive concepts described. For example, in the embodiment illustrated in FIGS. 4A and 4B, both engine valves are outwardly-opening crossover poppet valves and are actuated by a dwell cam with a variable valve actuation system. Such is not always the case, however. For example, one or both of the crossover valves can be actuated by a cam having no dwell section or using a cam-less system. Also, one or both of the crossover valves can be inwardly-opening. There can also be more than two crossover valves, and more than one crossover passage. The intake and exhaust valves, and any other valve in the engine for that matter, can also be actuated and/or deactivated using the systems disclosed herein. The cams can be mounted to separate camshafts or can be mounted to the same camshaft. In one embodiment, the engine valves 406A, 406B are actuated by the same cam. The engines disclosed herein are not limited to having only two cylinders. Accordingly, it is intended that the invention not be limited to the described embodiments, but that it have the full scope defined by the language of the following claims.

The invention claimed is:

1. A valve actuation system, comprising:

a bearing element coupled to an adjustable hydraulic tappet;

a cam configured to impart motion to the bearing element and thereby rotate a rocker arm when the bearing element is positioned between an eccentric portion of the cam and a rocker pad formed on the rocker arm;

an engine valve coupled to the rocker arm such that rotation of the rocker arm in a first direction is effective to open the engine valve and rotation of the rocker arm in a second direction opposite from the first direction is effective to close the engine valve;

a trigger valve having an open configuration in which fluid in the adjustable hydraulic tappet can flow through the trigger valve to a hydraulic accumulator and a closed configuration in which fluid is maintained in the adjustable hydraulic tappet, the trigger valve allowing the adjustable hydraulic tappet to be selectively drained of and filled with hydraulic fluid such that a position of the bearing element can be adjusted;

a spool valve having a first configuration in which the adjustable hydraulic tappet is placed in fluid communication with the trigger valve such that the engine valve is activated and a second configuration in which the adjustable hydraulic tappet is hydraulically disconnected from the trigger valve and is instead placed in fluid communication with the hydraulic accumulator such that the engine valve is deactivated; and a solenoid configured to selectively place the spool valve in the first configuration or the second configuration.

2. A valve actuation system, comprising:

a bearing element having first and second opposed bearing surfaces and being coupled to an adjustable hydraulic tappet by a connecting arm;

a cam configured to slidably engage the first bearing surface of the bearing element to impart motion to the bearing element and thereby rotate a rocker arm when the bearing element is positioned between an eccentric portion of the cam and a rocker pad formed on the rocker arm such that the second bearing surface of the bearing element slidably engages the rocker pad;

an engine valve coupled to the rocker arm such that rotation of the rocker arm in a first direction is effective to open the engine valve and rotation of the rocker arm in a second direction opposite from the first direction is effective to close the engine valve;

a trigger valve that allows the adjustable hydraulic tappet to be selectively drained of and filled with hydraulic fluid such that a position of the connecting arm and the bearing element can be adjusted;

a spool valve having a first configuration in which the adjustable hydraulic tappet is placed in fluid communication with the trigger valve such that the engine valve is activated and a second configuration in which the adjustable hydraulic tappet is hydraulically disconnected from the trigger valve and is instead placed in fluid communication with a hydraulic accumulator such that the engine valve is deactivated; and a solenoid configured to selectively place the spool valve in the first configuration or the second configuration.

* * * * *